US007172037B2

(12) United States Patent
Dashevskiy et al.

(10) Patent No.: US 7,172,037 B2
(45) Date of Patent: Feb. 6, 2007

(54) REAL-TIME DRILLING OPTIMIZATION BASED ON MWD DYNAMIC MEASUREMENTS

(75) Inventors: Dmitriy Dashevskiy, Celle (DE); John D. Macpherson, Celle (DE); Vladimir Dubinsky, Houston, TX (US); Pat McGinley, Sugar Land, TX (US)

(73) Assignee: Baker Hughes Incorporated, Houston, TX (US)

( * ) Notice: Subject to any disclaimer, the term of this patent is extended or adjusted under 35 U.S.C. 154(b) by 284 days.

(21) Appl. No.: 10/814,918

(22) Filed: Mar. 31, 2004

(65) Prior Publication Data

US 2004/0256152 A1 Dec. 23, 2004

Related U.S. Application Data

(60) Provisional application No. 60/459,283, filed on Mar. 31, 2003.

(51) Int. Cl.
*E21B 25/16* (2006.01)
*E21B 19/08* (2006.01)

(52) U.S. Cl. ..... 175/25; 175/27

(58) Field of Classification Search ..... 175/57, 175/61, 62, 26, 27, 38
See application file for complete search history.

(56) References Cited

U.S. PATENT DOCUMENTS

| | | | | |
|---|---|---|---|---|
| 4,739,841 A | | 4/1988 | Das | 175/61 |
| 5,947,213 A | | 9/1999 | Angle et al. | 175/24 |
| 6,012,015 A | | 1/2000 | Tubel | 702/6 |
| 6,021,377 A | | 2/2000 | Dubinsky et al. | 702/9 |
| 6,026,911 A | | 2/2000 | Angle et al. | 175/24 |
| 6,109,368 A | * | 8/2000 | Goldman et al. | 175/39 |
| 6,408,953 B1 | * | 6/2002 | Goldman et al. | 175/39 |

(Continued)

FOREIGN PATENT DOCUMENTS

| | | |
|---|---|---|
| DE | 19941197 | 9/1998 |

(Continued)

OTHER PUBLICATIONS

*Lateral Drillstring Vibrations in Extended-Reach Wells*, G. Heisig, SPE, Baker Hughes INTEQ, M. Neubert, SPE, Baker Hughes INTEQ GmbH, paper presented at the 2000 IADC/SPE Drilling Conference held in New Orleans, LA, Feb. 23-25, 2000.

(Continued)

*Primary Examiner*—Frank S. Tsay
(74) *Attorney, Agent, or Firm*—Madan, Mossman & Sriram, P.C.

(57) ABSTRACT

A drilling control system provides, in one aspect, advisory actions for optimal drilling. Such a system or model utilizes downhole dynamics data and surface drilling parameters, to produce drilling models used to provide to a human operator with recommended drilling parameters for optimized performance. In another aspect, the output of the drilling control system is directly linked with rig instrumentation systems so as to provide a closed-loop automated drilling control system that optimizes drilling while taking into account the downhole dynamic behavior and surface parameters. The drilling models can be either static or dynamic. In one embodiment, the simulation of the drilling process uses neural networks to estimate some nonlinear function using the examples of input-output relations produced by the drilling process.

26 Claims, 11 Drawing Sheets

U.S. PATENT DOCUMENTS

| | | | | |
|---|---|---|---|---|
| 6,772,134 | B1 | 8/2004 | Jacubasch | |
| 6,944,547 | B2 * | 9/2005 | Womer et al. | 702/7 |
| 6,968,909 | B2 * | 11/2005 | Aldred et al. | 175/26 |
| 2002/0120401 | A1 | 8/2002 | Macdonald | |
| 2002/0124652 | A1 | 9/2002 | Schultz | |

FOREIGN PATENT DOCUMENTS

| | | | |
|---|---|---|---|
| EP | 0595033 | A2 | 5/1994 |
| EP | 0718641 | A2 | 6/1996 |
| EP | 1126129 | A1 | 8/2001 |
| EP | 0881357 | | 5/2002 |
| GB | 2340944 | A | 3/2000 |
| GB | 2352046 | A | 1/2001 |
| JP | 6346448 | A | 12/1994 |
| WO | WO97/31175 | | 8/1997 |
| WO | WO98/17894 | | 4/1998 |
| WO | WO00/50728 | | 8/2000 |
| WO | WO01/61140 | | 8/2001 |
| WO | WO01/61140 | A1 | 8/2001 |
| WO | WO02/38915 | A2 | 5/2002 |

OTHER PUBLICATIONS

*Real-time Drilling Optimization Based on MWD Dynamic Measurements-Field Test Results*, Dashevskiy D.[1], Macpherson J.D.[1], Dubinsky V.[1], McGinley, P.[1], [1]Baker Hughes, presented at the AADE 2003 National Technology Conference "Practical Solutions for Drilling Challengers", held at the Radisson Astrodome Houston, Texas Apr. 1-3, 2003.

*Improving Drilling Performance by Applying Advanced Dynamics Models*, M.W. Dykstra, SPE, Hughes Christensen, M. Neubert, SPE, Baker Hughes, INTEQ, J.M. Hanson, SPE, Consultant, M.J. Meiners, SPE, Hughes Christensen, presented at the SPE/IADC DrillingConference held in Amsterdam, The Netherlands, Feb. 27-Mar. 1, 2001.

*Field Experiences with Computer Controlled Drilling*, Brett, J.F., Warren, T.M., Wait, D.E., (Paper SPE 20107).

*Measurement of BHA Vibration Using MWD*, Close, D.A., Owens, S.C. and Macpherson J.D., SPE/IADC 17273, 1988.

*Downhole Diagnosis of DrillingDynamics Provides New Level Drilling Process Control to Driller*, Heisig, G., Sancho, J., Macpherson J.D., SPE 49206, 1998.

*An Interactive Drilling Dynamics Simulator for Drilling Optimization and Training*, Dubinsky, V.S. Baecker, D. R., Paper SPE 49205, 1998.

*A New Approach to Interpreting Rock Drillability*, Bingham, M.G., Petroleum Publishing Company, 1965.

*Application of Drilling Performance Data to Overpressure Detection*, Jordan, J.R. and Shirley, O.J., 1966, JPT, No. 11.

*AGIP Deep Drilling Technology—2*, Bellotti P., and Giacca D., OGJ, vol. 76, No. 35, pp. 148.

*Drilling Model for Soft-Formation Bits*, Warren T.M., 1981, JPT, vol. 33, No. 6, pp. 963.

*Roller Bit Model with Rock Ductility and Cone Offset*, Warren T.M., and Oniya E.C., 1987, SPE 16696.

*The Application of a New Drilling Model for Evaluating Formation and Downhole Drilling Conditions*, Jogi P.N., and Zoeller W.A., 1992, SPE 24452.

* cited by examiner

REAL-TIME DRILLING OPTIMIZATION BASED ON MWD DYNAMIC MEASUREMENTS

CROSS-REFERENCE TO RELATED APPLICATIONS

This application takes priority from U.S. Provisional Application No. 60/459,283, filed Mar. 31, 2003.

FIELD OF THE INVENTION

This invention relates generally to drilling of wellbores and more particularly to real-time drilling based on downhole dynamic measurements and interactive models that allow real-time corrective actions and provide predictive behavior.

BACKGROUND OF THE INVENTION

Real-time drilling optimization that relies primarily on surface data has proven ineffective because it does not take into account downhole dynamics, such as the behavior of a bottomhole assembly (BHA) within the wellbore. Surface controlled parameters such as weight-on-bit and rotary speed optimized for maximum penetration rate are of little use if they induce severe downhole vibration that results in costly damage to the BHA. A measurement-while-drilling ("MWD") dynamics measurement tool is, therefore, a very useful component of a closed-loop-drilling control system (DCS).

Early control systems either ignored the downhole dynamics component or recommended very broad actions, such as the practice of avoiding predefined bands of rotary speed. These early attempts at automated control were further hindered by the state of existent rig instrumentation and control systems, and the available computing power. Several early systems included some form of expert-system, typically a rule-based system overlaying a knowledge base. The disadvantage of such systems was their inability to cover all or substantially all potential scenarios, and they quickly lost the confidence of the end-user.

In 1990, Brett, Warren and Wait documented the most serious effort up to that point in time in Brett, J. F., Warren, T. M., Wait, D. E., "Field Experiences with Computer Controlled Drilling" (Paper SPE 20107), which is incorporated herein by reference for all purposes. The paper suggested that computer based drilling control systems were possible and capable of achieving meaningful results. However, they stated that achieving an economically viable system was not a simple task primarily due to the cost of the improved rig instrumentation and control infrastructure required. It was postulated that this was the main issue underlying the failed emergence of a commercial system. It should be pointed out that even in the early 1990's the efforts to develop DCS systems still paid little attention to downhole dynamics components of the control equation, thus were limited in their capabilities.

The early 1990's saw the introduction of improvements to rig instrumentation systems that represented a step change in the drilling control process. Rig instrumentation networks, the majority running on some form of Profibus System, now had high-speed access to upwards of 2,500 rig sensors. The replacement of the old style band brake drawworks with new hydraulic based systems allowed for dynamic control of WOB, both positively and negatively. New and smarter "Automated Drillers" were introduced. Systems that could maintain steady drilling conditions by referencing parameters such as WOB, RPM, Delta Standpipe Pressure and Torque. These systems were capable of swapping between the primary controlling parameter as conditions varied. However, they still lacked the important link to definitive downhole dynamic measurements.

The early 1990's also saw the introduction of the first reliable downhole dynamics measurements. Such measurements are described in Close, D. A., Owens, S. C. and Macpherson J. D., "Measurement of BHA Vibration Using MWD", SPE/IADC 17273, 1988 and Heisig, G., Sancho, J., and Macpherson J. D., "Downhole Diagnosis of Drilling Dynamics Provides New Level Drilling Process Control to Driller", SPE 49206, 1998, both of which are incorporated herein by reference for all purposes. Earlier work carried out on surface based measurement systems had proven the need for definitive downhole measurements. The cause and effect of dysfunctional dynamics was now understood. One of the last remaining hurdles to a viable drilling control system was low telemetry rate between the downhole dynamic stools and the surface systems, which currently are typically 2–10 bps. Early attempts at using surface simulators to extrapolate anticipated downhole dynamics behavior, as discussed in Dubinsky, V. S. Baecker, D. R., "An interactive Drilling Dynamics Simulator for Drilling Optimization and Training," Paper SPE 49205, 1998, which is incorporated herein by reference for all purposes, in order to provide advice on drilling parameter selection, were somewhat successful, but highlighted the complexity and non linear nature of the dynamics problem.

For the last couple of decades a variety of mathematical models, usually termed drilling models, have been developed to describe the relationship between applied forces and motions (for example, weight-on-bit and rotary speed), and the obtained rate of-penetration. Both analytical and numerical approaches have been suggested to describe the very complex three-dimensional movement of the BHA. In many of these empirical models the relationship was in terms of a "bulk" formation related parameter, such as the formation constants of Bingham's early work. One of these constants was later related to formation pore pressure by Jordan and Shirley and the use of drilling models as pore pressure "predictors" was initiated. Several models followed, such as Wardlaw's analytic model Belloti and Gacia's sigma-factor Warren's drilling models, and Jogi's drillability equation, all attempting to describe the relationship between control parameters and observed rate-of-penetration with varying degrees of complexity. The following herein are incorporated by reference for all purposes: 12. Bingham, M.G., "A New Approach to Interpreting Rock Drillability", Petroleum Publishing Company, 1965; 13. Jordan, J. R and O. J. Shirley, 1966, "Application of Drilling Performance Data to Overpressure Detection" JPT, No 11; 14. Wardlaw, H. W. R., 1972, "Optimization of Rotary Drilling Parameters" PhD Thesis, University of Texas; 15. Bellotti P., and Giacca D. "AGIP Deep Drilling Technology—2", OGJ, vol 76, No. 35, pp 148; 16. Warren T. M., 1981, "Drilling Model for Soft-Formation Bits", JPT, vol 33, no. 6, pp 963; 17. Warren T.M., and Oniya E. C., 1987, "Roller Bit Model with Rock Ductility and Cone Offset", SPE 16696; 18. Jogi P. N., and Zoeller W. A., 1992, "The Application of a New Drilling Model for Evaluating Formation and Downhole Drilling Conditions", SPE 24452.

During the past 20 years the high-profile technology developments within the energy industry have focused primarily on production, this being driven by the move to deepwater and other challenging environments. Development of downhole and surface drilling technology has, to a great degree, been left to the service companies and drilling contractors. The high spread-costs of deepwater exploration has resulted in the drive for improved drilling performance in harsh and expensive environments, coupled with a demand for greater reliability from increasingly more complex downhole MWD tools.

These goals are not exclusive, but rather are interdependent, as it is frequently unacceptable to optimize one performance parameter to the detriment of the other. Hence, the need for a system that takes a combination of surface and downhole data inputs, and recommends drilling parameters selected so as to optimize rate-of-penetration (ROP) while at the same time allowing the BHA to behave within acceptable limits.

The present invention addresses some of the above-noted deficiencies of prior systems and provides drilling systems that utilize downhole drilling dynamics, surface parameters and predictive neural network models for controlling drilling operations and to predict optimal drilling.

SUMMARY OF THE INVENTION

This invention provides a control system that in one aspect uses a neural network for predictive control for drilling optimization. The system can operate on-line during drilling of wellbores. The system acquires surface and downhole data and generates quantitative advice for drilling parameters (optimal, weight-on-bit, rotary speed, etc.) for the driller or for automated-closed-loop drilling. The system may utilize a real-time telemetry link between an MWD sub and the surface to transfer data or the data may be stored downhole of later use. Data from offset wells can be used successfully to describe the characteristics of the formation being drilled and the upcoming formation. The relationship between these formation parameters and the dynamic measurements may be utilized in real-time or investigated off-line, once the dynamics information is retrieved at the surface. Such a scenario may be likely, when there is substantial time-delay in getting MWD information to surface. The data can be processed downhole with models stored in the MWD and used in real-time, to alter, at least some of the drilling parameters.

In another aspect, the present invention provides advice and/or intelligent control for a drilling system for forming a wellbore in a subterranean formation. An exemplary drilling system includes a rig positioned at a surface location and a drill string conveyed into the wellbore by the rig. The drill string has a bottomhole assembly (BHA) attached at an end thereof. A plurality of sensors distributed throughout the drilling system for measure surface responses and downhole responses of the drilling system during drilling. Exemplary surface responses include oscillations of torque, surface torque, hook load, oscillations of hook load, RPM of the drill string, and rate-of-penetration. Exemplary downhole responses include drill string vibration, BHA vibration, weight-on-bit, RPM of the drill bit, drill bit RPM variations, and torque at the drill bit. In some arrangements, the measured downhole responses are preprocessed and decimated by a downhole tool (e.g., MWD tool or downhole processor and transmitted uphole via a suitable telemetry system.

In one embodiment, a controller (or "Advisor") for controlling the drilling system uses the sensor measurements (i.e., the surface and downhole responses) to generate a value or values for one or more drilling parameters ("advice parameter") that, if used, is predicted to optimize a selected parameter such as rate-of-penetration ("optimized parameter") or hole clearing. The controller is also programmed with one or more constraints that can be considered user-defined norms (e.g., a value that is an operating set-point, a range, a minimum, a maximum, etc.) for one or more control parameters. The control parameters include, but are not limited to, weight-on-bit, RPM of the drill string, RPM of the drill bit, hook load, drilling fluid flow rate, and drilling fluid properties. During operation, the controller uses on or more models for predicting drilling system behavior, the measured responses and the selected parameters to determine a value for an advice parameter that is predicted to produce the optimized drilling parameter while keeping drilling within the specified constraints. In certain embodiments, the controller uses a neural network. The advice parameters include, but are not limited to, drilling fluid flow rate; drilling fluid density, weight-on-bit, drill bit RPM, and bottomhole pressure.

Suitable embodiments of the model used by the controller include "historical data" relating to the characteristics of the formation being drilled and the past behavior of the drilling system. For instance, the model can include data relating geometry of the BHA, mechanical parameters of the BHA, characteristics of a drill bit carried by the BHA, characteristics of a drilling motor in the BHA, wellbore geometry, well profile, lithology of the subterranean formation being drilled, mechanical properties of the subterranean formation being drilled, lithology data obtained of an offset well, and formation mechanical property data obtained from an offset well. In certain embodiments, the controller includes a plurality of model modules, each of which are associated a different system response. In addition to determining a response based on measured data, a model module calculates a cost for the response. In one embodiment, the controller normalizes the costs of the several responses in determining the advice parameter. Also, in several embodiments wherein real-time drilling data is dynamically updated, the controller updates one or more models in real-time using an error calculation between a measured value for a drilling system response and a predicted value for the drilling system response.

In another embodiment, the controller provides closed-loop control for the drilling system wherein the determined advice parameter is used to issue appropriate command signals to the drilling system.

Examples of the more important features of the invention have been summarized (albeit rather broadly) in order that the detailed description thereof that follows may be better understood and in order that the contributions they represent to the art may be appreciated. There are, of course, additional features of the invention that will be described hereinafter and which will form the subject of the claims appended hereto.

BRIEF DESCRIPTION OF THE DRAWING

For detailed understanding of the present invention, references should be made to the following detailed description of the preferred embodiment, taken in conjunction with the accompanying drawings, in which like elements have been given like numerals and wherein.

DESCRIPTION OF THE PREFERRED EMBODIMENT(S)

In one aspect, the present invention describes a system that provides advisory actions for optimal drilling. Such a system is referred to herein as an "Advisor." The "Advisor" system utilizes downhole dynamics data and surface drilling parameters, to produce drilling models that provide a human operator (or "Driller") with recommended drilling parameters for optimized performance. In another aspect, the present invention provided a system and method wherein the output of an "Advisor" system is directly linked with rig instrumentation systems so as to provide a closed-loop automated drilling control system ("DCS"), that optimizes drilling while taking into account the downhole dynamic behavior and surface parameters. Preferably, the drilling control system has close interaction with a drilling contractor and a rig instrumentation provider (e.g., the development of a "man safe" system with well understood failure behavioral modes). Also, links are provided to hole cleaning and annular pressure calculations so as to ensure an annulus of the well is not overloaded with cuttings. Thus, embodiments made in accordance with the present invention can, in one mode, help an operator or driller optimize the performance of a rig and, in another mode, be self-controlling with an override by the Driller.

Figure 1A:
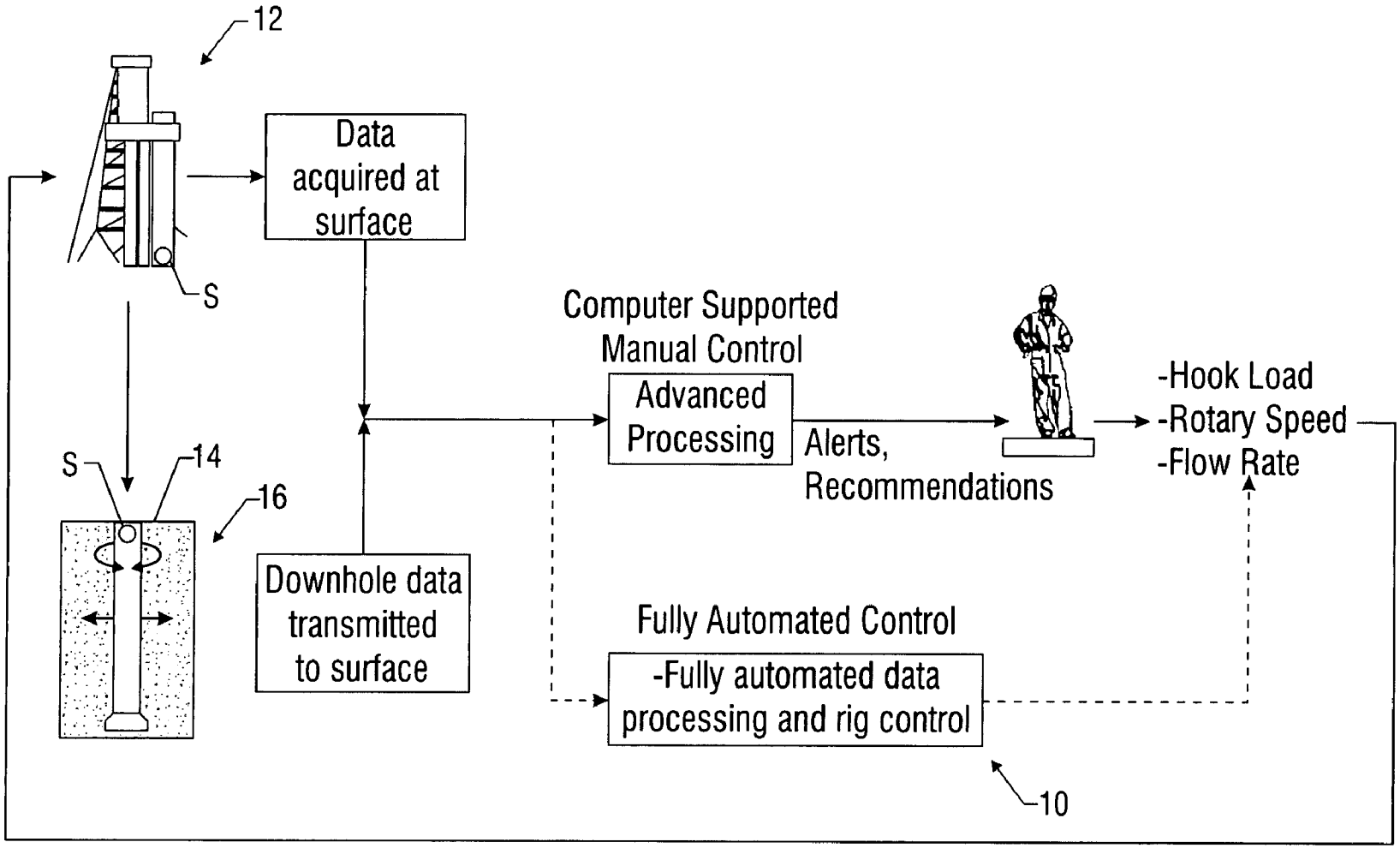
FIG. 1A shows an embodiment of a simplified data flow diagram according to the present invention for use in drilling of wellbores.

Referring to FIG. 1A, there is shown in flow chart form the control and data flow for a drilling control system 10 made in accordance with the present invention. A rig 12 at the surface and a bottomhole assembly (BHA) 14 in a well 16 are provided with sensors (not shown) that measure selected parameters of interest. These measurements are transmitted via a suitable telemetry system to the drilling control system 10. In an exemplary deployment, a system engineer or a Driller or an operator ("operator") inputs or dials acceptable vibration levels into the Drilling Control System 10 and requests the system 10 to keep control parameters within optimal ranges that fall within user defined end points (operating norms). Minimum and maximum acceptable values for WOB, RPM and Torque, and for various types of vibration (lateral, axial and tosional) are specified. Tolerance of highly undesirable occurrences, such as whirl, bit bounce, stick-slip and, to some degree, torsional oscillation, are set at a number approaching zero.

In one aspect, this invention aims at obtaining the optimum drilling parameters (for example weight-on-bit (WOB), drillbit rotation per minute (RPM), fluid flow rate, fluid density, bottom hole pressure, etc.) to produce the optimum rate-of-penetration while drilling. The optimum rate-of-penetration may be less than the maximum rate-of-penetration when damaging vibrations occur or due to other constraints placed on the system, such as a set MWD logging speed.

Once a model has described the relationship between the system input and output sufficiently well, then the model can be used to answer certain inverse questions, such as: "What is the weight-on-bit and rotary speed to obtain the optimum rate-of penetration?" In other words, these models may be used in a drilling control system whose goal is to optimize the rate-of-penetration. However, cursory inspection reveals that a more complete question that may be asked is: "Given a certain size and type of bit, on the end of a certain selected drillstring, at a certain depth, drilling with certain mud properties and flow rates in a certain lithology, what is the weight-on-bit and rotary speed to obtain the optimum rate-of penetration?" Unfortunately this question is so complex, involving the interaction of so many different components (only a few of which are listed), that it is difficult to utilize the developed drilling models to obtain an answer. In addition, the developed drilling models are linear while the drilling process contains non-linearities (the intersection of a bed boundary by the drill bit is an example), and the achievement of an optimized rate-of penetration may result in destruction of the BHA, because most models do not deal with drillstring dynamics.

In certain embodiments, the model used in a control system accounts for dynamics of the drillstring. Applying a certain set of control parameters results not only in a certain rate-of-penetration, but also in certain motions and forces in the BHA, which must be measured downhole while drilling.

As discussed above, there are several possible options for a mathematical description of the drilling process as a complex system with many influencing parameters. In one embodiment, this invention treats the drilling process as a dynamic system.

Dynamic systems can be viewed in two ways: the internal view or the external view. The internal view attempts to describe the internal workings of the system and it originates from classical mechanics. A classical problem is discussed in literature is the problem to describe the motion of the planets. For this problem, it seemed natural to give a complete characterization of the motion of all planets. The other view on dynamic systems originated in electrical engineering. The prototype problem discussed is to describe electronic amplifiers. In such a case, it was thought natural to view an amplifier as a device that transforms input voltages to output voltages and to disregard the internal detail of the amplifier. This resulted in the input-output view of systems. Such models are often referred to as input output models or "black box" models.

In application where there is relatively little real-time information about the internal state of the whole drilling system, it is preferred that a "black box" approach be used for modeling of the drilling process although other approaches may be equally suitable in certain applications.

Figure 1B:
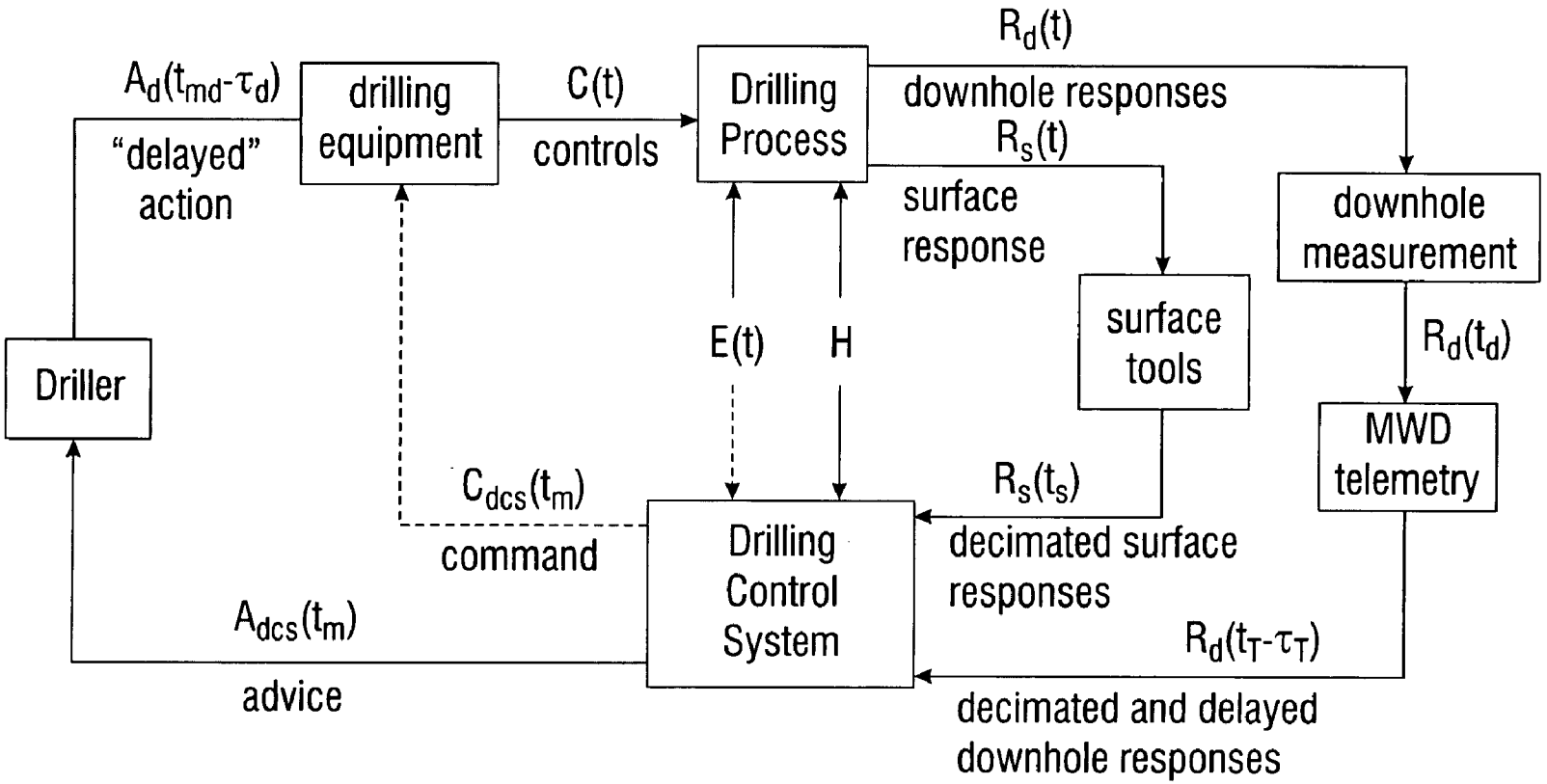
FIG. 1B shows another embodiment of a data flow diagram according to the present invention.
Figure 1C:
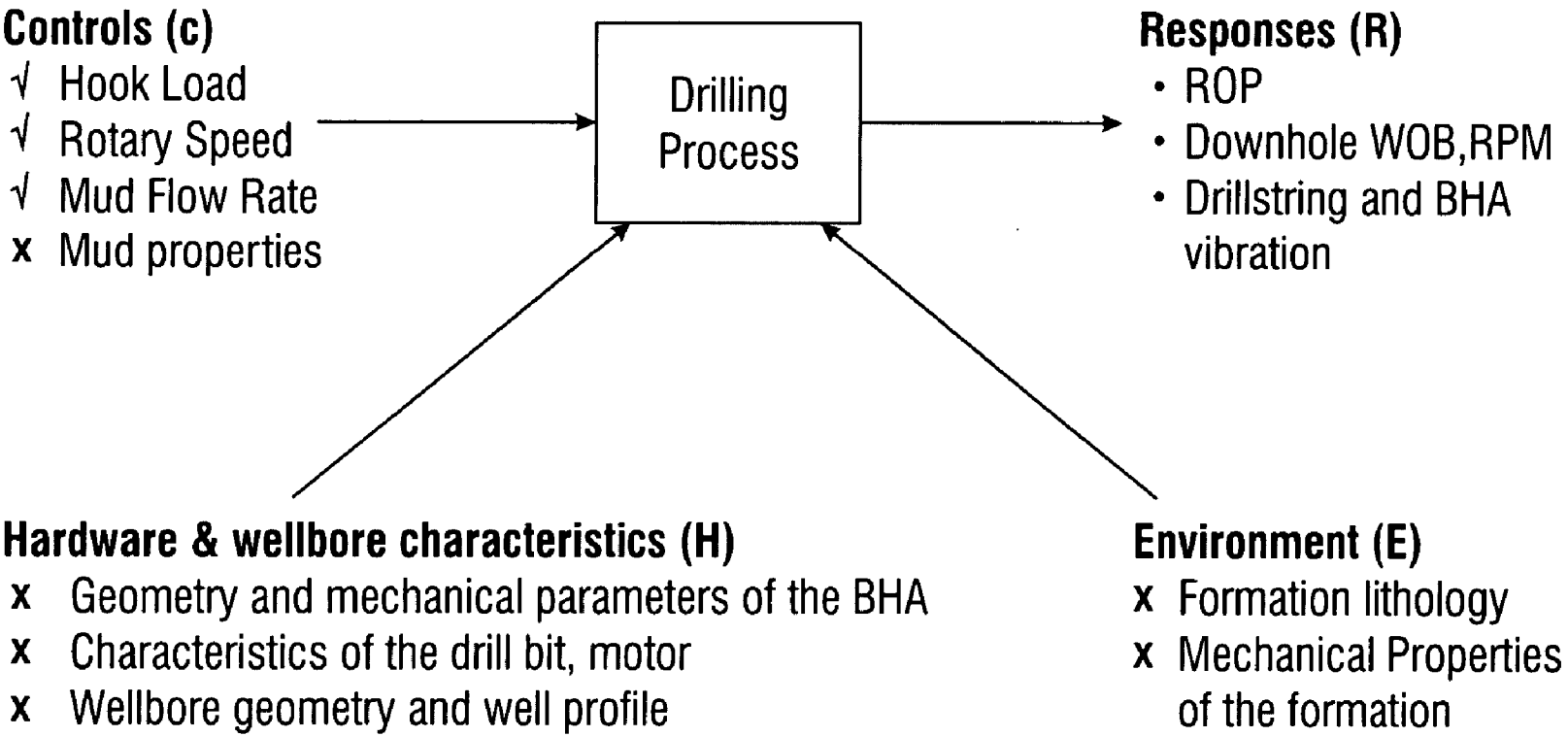
FIG. 1C shows exemplary parameters that affect a drilling process that are considered in developing one embodiment of a system of the present invention.

Referring to FIGS. 1B and 1C, there are shown in flowchart form one approach wherein the drilling process can be thought of as one that is affected by the following exemplary categories: (i) controls comprising Hook Load, Rotary Speed, and Mud Flow Rate (drilling parameters referred to with numeral C(t)); environment, including, for example, lithology and mechanical properties of the formation, etc. (formation parameters referred to with numeral E(t); and hardware, which consists of BHA (Bottom Hole Assembly), drill bit, wellbore geometry, etc. (drill string and BHA parameters referred to with numeral H(t)).

Controls (C) and Environment (E) change continuously while drilling. Hardware changes from run to run, but it is known and can be considered as a set of constants for particular bit run. In certain applications, environment is unknown. In other applications, environment is known approximately and partially from offset wells. Under the influence of these inputs (C, E, H) the drilling process generates responses, i.e. outputs of the "black box". Some of these inputs can be measured at the surface (surface responses—$R_S$), e.g. ROP, surface torque, oscillations of hook load and drill string RPM, etc., while others are preferably measured downhole (downhole responses—$R_D$), e.g. actual WOB, bit RPM variations, torque at the bit and other parameters characterizing drill bit and BHA dynamics. In one embodiment, responses measured downhole are preprocessed and decimated by a multi-channel MWD drilling dynamics tool that reduce the amount of data to be transmitted to the surface via a telemetry. In certain embodiments, an MWD telemetry system can be used to transmit data from the BHA and drillstring to the surface. If an MWD telemetry system is used then the downhole data are significantly delayed, and thus further decimated. Additionally, the downhole BHA may include further processing capability that processes the downhole data and determines advice or actions that need to be taken and also to provide predictions. Such a data processing reduces the downhole data to a manageable level for transmission.

In one embodiment, the Drilling Control System may use all available data to generate advice parameters for the Driller and acts as a Drillers' Advisor. In a separate embodiment, the Drilling Control System can deliver a command directly to the drilling control equipment to provide a Closed Loop Drilling Control System. In both cases, the DCS operates as a discrete system, on a time step-by-step basis. This time step, $\tilde{\Delta}t$ (modeling time step), is bounded by a minimum value: $T_D \geq \tilde{\Delta}t$. This lower boundary ($T_D$) is determined by the availability of the "fastest" data and the speed at which the data can be processed at each time-step. For example, $T_D$ may be a short time interval (e.g., five seconds).

Experiments have generally shown that it takes about two to three minutes for the drilling process to stabilize. The magnitude of the stabilization time ($T_S$) can be used to determine the manner in which the drilling process may be simulated. If $T_D$ is significantly smaller than $T_s$ and a small $\tilde{\Delta}t$ can be chosen, then the control system can trace the dynamics of the drilling process, i.e., how the responses change from one time step to the next. Otherwise, it may be preferable to consider drilling as a sequence of "drilling steps." Each step being a transition from one stable state to another stable state. The duration of each step is not necessarily fixed, but is determined by the events when changes in controls or information occur. Such a case would be static drilling models.

Figure 2:
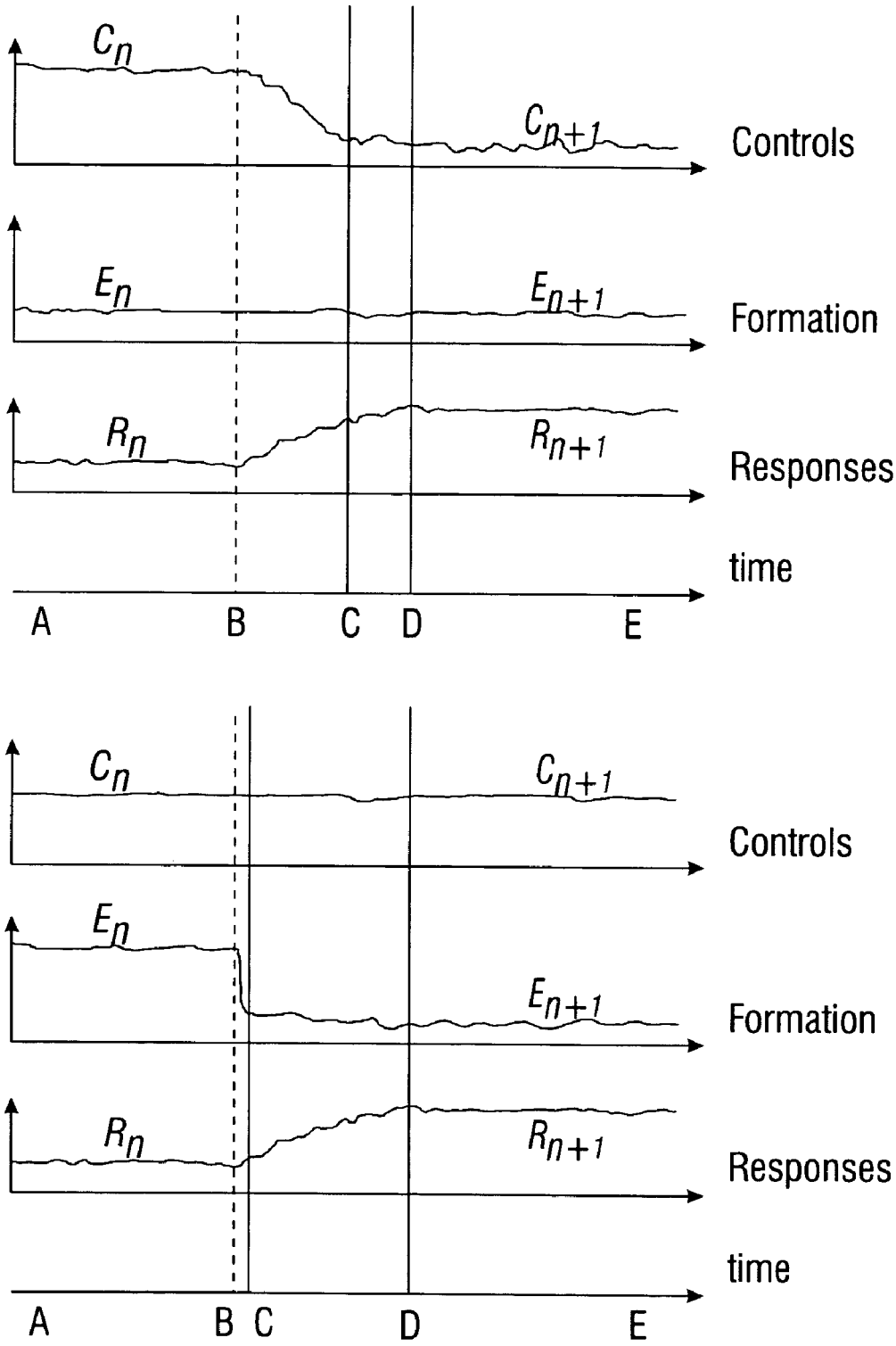
FIG. 2 graphically illustrates the response of an exemplary drilling system to changes in selected parameters.

The response of the system usually remains stable when controls and environment do not change. Changes in controls (C) and/or environment (E) tend to disturb the system. But when the controls and environment stabilize, the system response stabilizes as well. Experiments have shown that the stabilization time is about two minutes. Thus, if $\tilde{\Delta}t \geq T_S$ (i.e., modeling time step is greater than the stabilization time) the dynamic behavior of the system cannot be traced. In such a case, the drilling process may be considered as composed of a set of "drilling steps" as shown in FIG. 2. Each step is a transition from one stable state ($C_n$, $E_n$, $R_n$) to another stable state ($C_{n+1}$, $E_{n+1}$, $R_{n+1}$). However, the duration of each of these steps might be different.

In one aspect, it can be assumed that there are only two reasons why transitions may occur: change in the values of the bottomhole pressure controls and/or environment.

In this case $R_{n+1}$ (the new values of the responses) depend on: (i) new values of controls ($C_{n+1}$) and environment ($E_{n+1}$ $\tilde{}$); (ii) previous stable state ($C_n$, $E_n$, $R_n$); and (iii) transition path or stage (stage BD).

In certain instances, the transition state BD may be difficult to formalize (e.g., when the Driller makes the changes, because, even the same Driller may have different ways of changing the control values). In those instances, this factor may not be very detrimental because preliminary field tests showed that, when formation does not change (i.e. $E_n$=const), the system response ($R_n$) in the stable state depends primarily on the control values ($C_n$). So, the following assumption can be used as a working hypothesis:

considering H being a constant, and that controls $C_{n+1}$ and environment $E_{n+1}$ adequately define $R_{n+1}$:

$$Rn+1=F(C_{n+1}, En+1) \tag{1}$$

Figure 3:
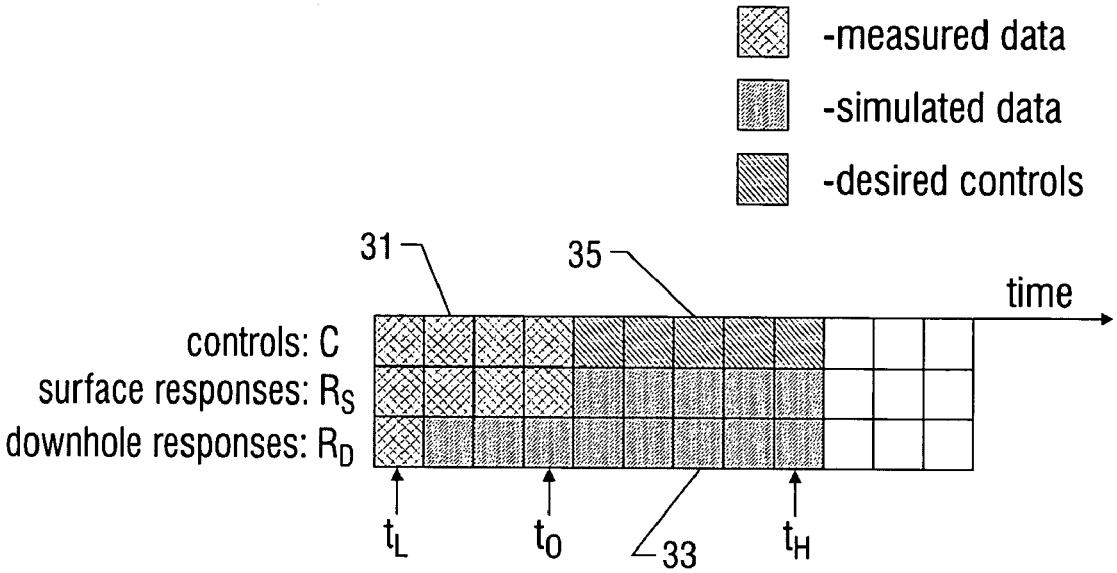
FIG. 3 shows a graphical representation of use of certain available data to predict system responses.

As previously mentioned, the dynamic model of the drilling process applies when the modeling time step is much less than the system stabilization time. The herein used approach to nonlinear system identification is to embed the measured input-output variables in a higher dimensional space built just with current values of controls and responses (C (t), R(t)), and also transforms of C, R (for example their numerical derivatives). Other suitable approaches may also be used. Practically, the behavior of the drilling process can be described by embedding both the inputs and outputs in the form:

$$R_{n+1}=F_R(C_{n+1},\{C_n, R_n\}, \ldots ,\{C_{n-N}, R_{n-N}\}) \tag{2}$$

where N is the number of time delays. FIG. 3 illustrates a simple example of a neural net model that uses available data to predict system response. In FIG. 3, the numeral 31 identifies measured data for controls C, surface responses $R_s$ and downhole responses $R_d$ over time t. The numeral 33 identifies simulated data over time for C, $R_s$ and $R_d$, and numeral 35 identifies desired controls for such parameters.

The simple model of FIG. 3 (with just one delay) may use the current control values of WOB ($t_0$) and RPM ($t_0$), the current surface response of torque ($t_0$), the current response of ROP ($t_0$), and the future controls of WOB ($t_0+\tilde{\Delta}t$), and RPM ($t_0+\tilde{\Delta}t$) to produce an estimate for the future ROP ($t_0+\tilde{\Delta}t$) and torque (t0+$\tilde{\Delta}t$) responses. In other embodiments of the present invention, more sophisticated models can use more delays, larger sets of controls and responses as well as environmental data as inputs.

These embedded models can be faithful to the dynamics of the original system. In particular, deterministic prediction can be obtained from an embedded model with a sufficient number of delays. Thus, embedding opens the way towards a general solution for extracting "black box" models of the observable dynamics of nonlinear systems directly from input-output time-series data relating to a drilling system. It can solve the fundamental existence problem for a class of nonlinear system-identification problems.

In the above-described embodiments, the simulation of the drilling process can estimate some nonlinear function using the examples of input-output relations produced by the drilling process. In one embodiment, neural networks can be used for this task due to their known "universal approximation" property. Neural networks with at least a single hidden layer have been shown to be able to approximate any arbitrary function (with a finite number of discontinuities) if there are a sufficient number of basis functions (hidden neurons). By changing the structure of the neural network, its capacity and generalization properties can be varied.

Figure 4:
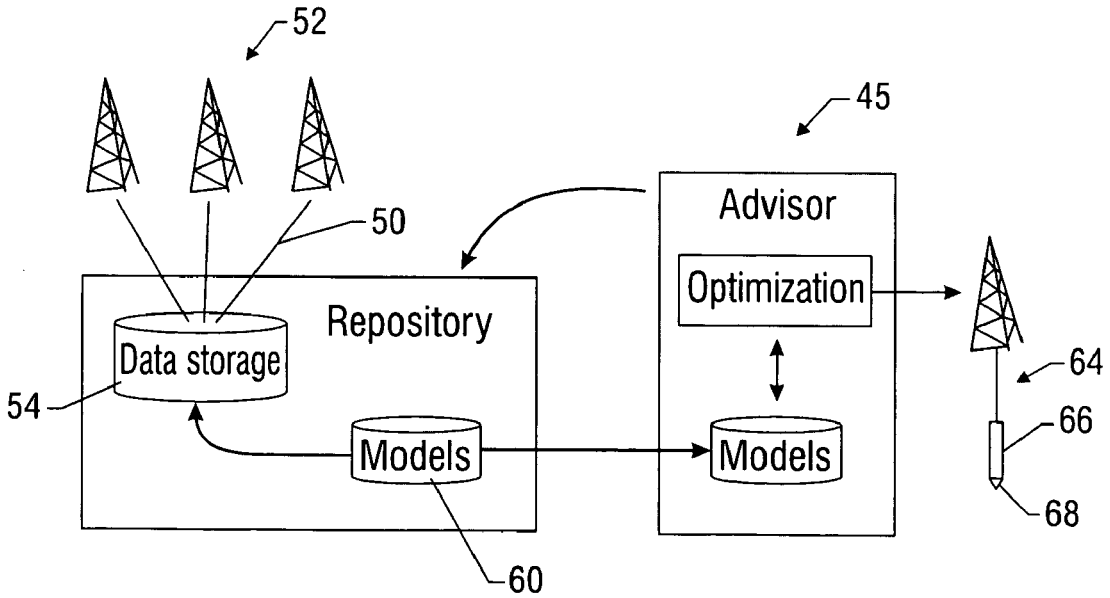
FIG. 4 shows a block diagram of an exemplary embodiment of a drilling control system made in accordance with the present invention.

A model created on the basis of "historical" data is applicable in situations similar to those observed in the data used for the construction of the model. In one embodiment, drilling performance over the entire range of operational parameters is optimized by using models created with data from more than one well. Referring now to FIG. 4, there is shown one strategy in implementing and using a controller or Advisor 45. The term "controller" should be construed in a generalized sense as a single or plurality of devices configured to receive data, process data, output results and/or issue appropriate instructions, etc. Data 50 collected from different wells 52 are merged and stored in a data storage device 54 associated with a data server. After a new well 64 has been planned and information about the BHA 66, drill bit 68, and other components of the drill string is available, a request is made for the relevant data model. Using this information, models 60 are created or extracted from the pool of available models. The system may be programmed to select the most appropriate model from a pool of models or it may create an appropriate model from the data stored or provided to the system. Thereafter, one or more of these models are used on the new well 64 for drilling optimization.

Figure 5:
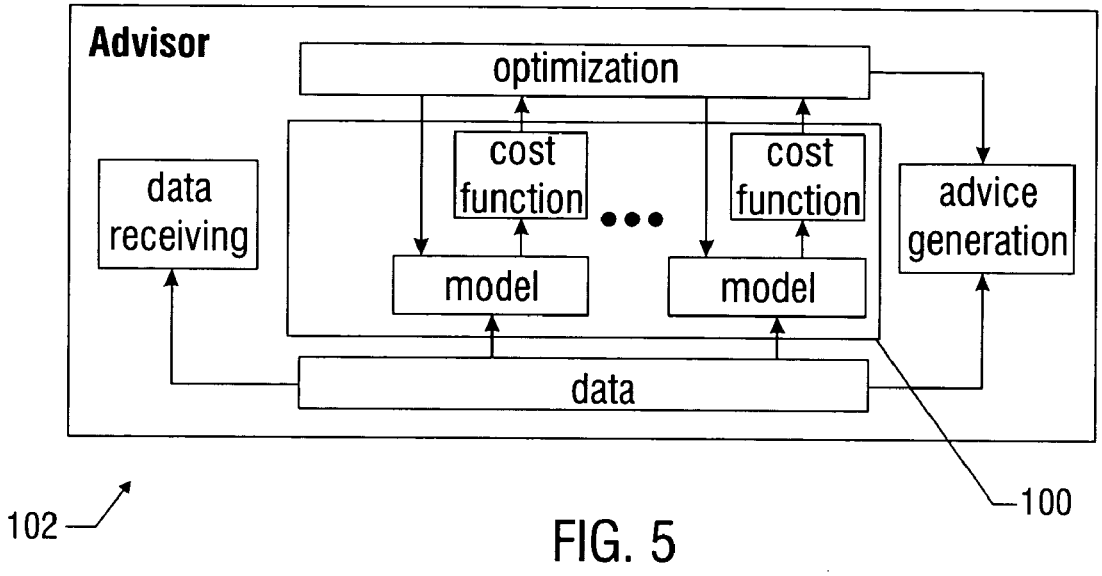
FIG. 5 shows a simplified block diagram of one embodiment of a drilling Advisor made in accordance with the present invention.

To make the system more robust, generic and easily extendable to future MWD tools, certain embodiments of the controller or Advisor have a modular structure. An example of a modular structure is shown in FIG. 5. Each module 100 is associated with some system response and the Advisor 102 uses sets of selected modules to generate recommendations. Modules 100 comply with a predefined external interface, but no constraints are preferably imposed on module implementation. The modules are preferably based on Neural Network models, but other types of mathematical models may also be utilized.

Each module 100 takes control parameters as inputs and produces a cost associated with the predicted value of the future response. Costs produced by different modules are normalized. This allows comparison of various responses, even if they are quite different in their nature (e.g. whirl vs. bit bounce). The system 102 can look at various comparisons and determine the overall impact of these multiple and often divergent responses to determine the overall impact on the drilling efficiency. The set of responses considered for optimization, and the corresponding cost functions associated with them, define the overall optimization strategy. In the present system, parameters relating to the operating cost of a rig can be also considered. The weight assigned to such operating costs can vary from rig to rig. For example, offshore rigs cost substantially more for each hour of down time compared to land rigs. The Advisor may determine that optimal drilling efficiency will be obtained by substantially reducing ROP in view of unwanted vibrations or in view of other relevant parameters.

Figure 6:
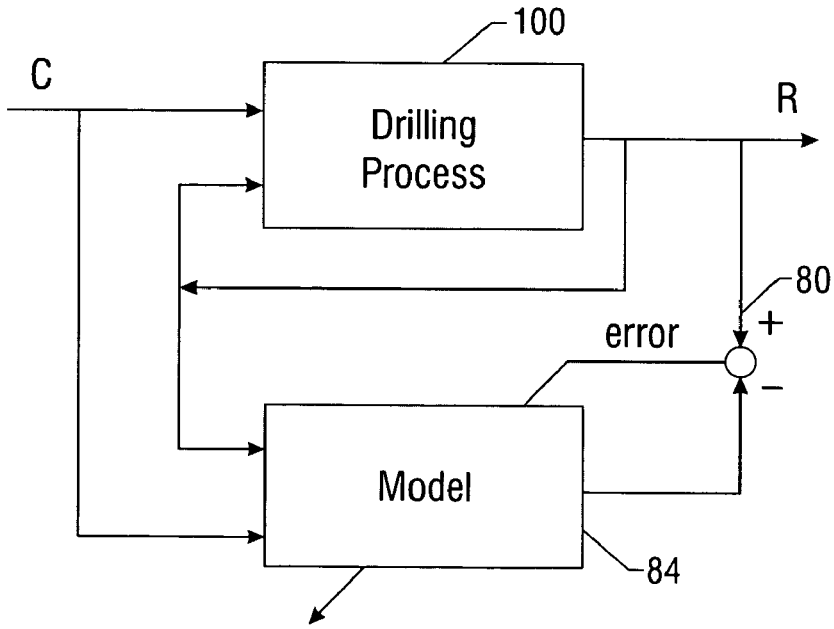
FIG. 6 shows a block diagram for adapting one embodiment of a neural network to current drilling conditions.

During the real-time operation of the Advisor, models can be adapted using recent real-time drilling data when found necessary. FIG. 6 shows one manner of such an adaptation. The error 80 between the recent real time data and the predicted values can be used for updating models 84 for the drilling process 100. This improves accuracy of the local prediction, both time- and state-wise, and increases stability of the control procedure.

Usually, it is not practical to have historical data for all combinations of parameters affecting drilling. Thus, models based on input-output data typically do some interpolation and extrapolation.

A controlled field experiment was performed to test the above described system and to estimate the accuracy of the underlying neural network models. This test was carried out at the BETA (Baker Hughes Experimental Test Area) facility located near Tulsa, Okla. A battery powered MWD drilling dynamics tool was used for downhole measurements. That multi-sensor tool acquired and processed a number of dynamic measurements downhole, and calculated diagnostic parameters which quantified the severity of the drilling vibrations. These diagnostics were then transmitted to the surface via MWD telemetry and/or stored into the tool memory.

During the field test, the detailed data stored in the tool memory during drilling were dumped to the surface computer on a periodic basis. Information about the formation at BETA facility was also available from offset wells. A PDC bit used in the test is presented in FIG. 7.

As downhole data became available it was processed to create models. Although training of the NN model (when data are prepared and structure of NN is defined) does not require human interaction, it can be a time consuming process, especially for big data sets.

It was decided to use static models, which have fewer inputs and hence can be trained much faster. This allowed a test of the majority of the Advisor software package and to view some "action" in real-time during the test. Further data processing, as well as comprehensive analysis of the dynamic models, was carried out after the field test.

This test was conducted by drilling at various values of WOB and RPM and through different formations, in order to collect a diverse data set. This diverse data set was then used for the following offline study. Mud properties, flow rate and BHA/bit were kept constant through the entire testing to minimize the number of factors affecting the drilling process.

Figure 7:
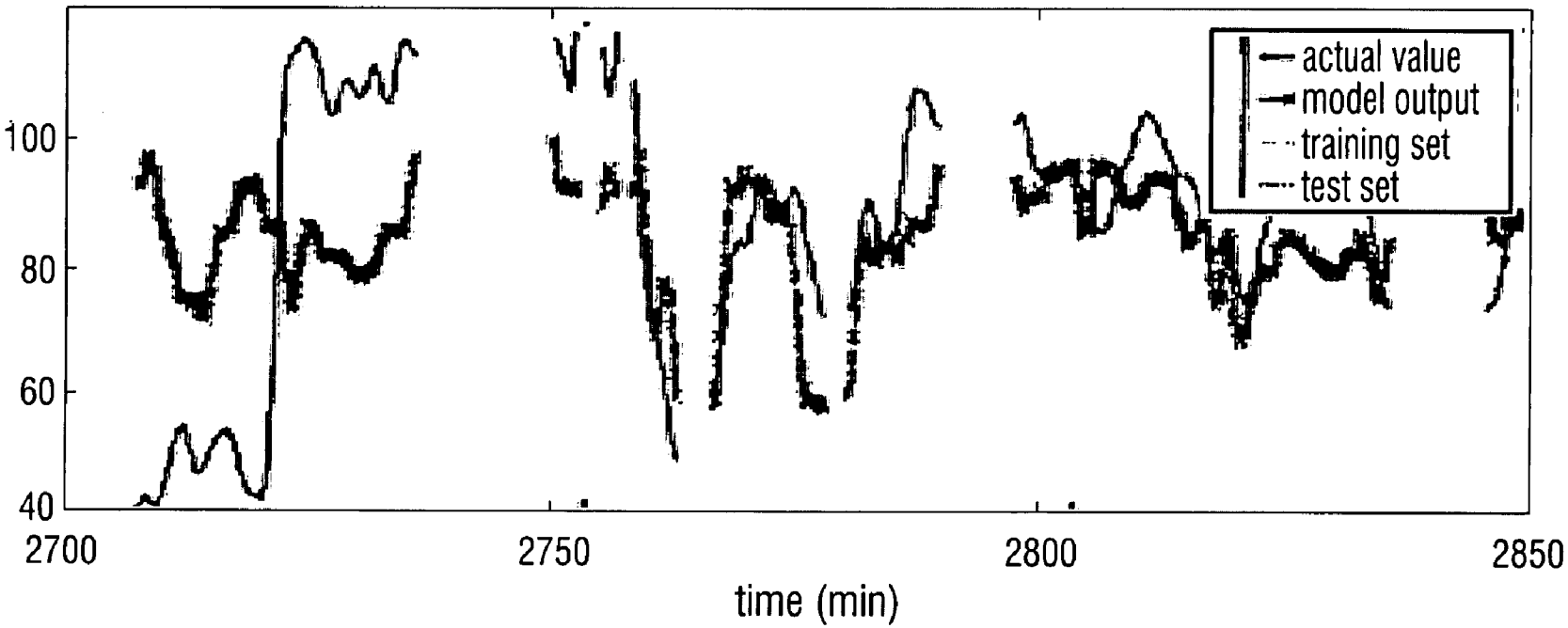
FIG. 7 graphically illustrates a comparison between actual and estimated gamma ray measurements.

During the test, the real-time computed true vertical depth (TVD) was used as a reference to determine formation properties at the corresponding depth from offset well data. Then these values together with surface, surface RPM (all averaged on one-minute intervals) were used as inputs to the NN models to estimate ROP and downhole diagnostics. Computed values of ROP were compared to those actually observed. As FIG. 7 illustrates they are in good agreement.

Figure 8:
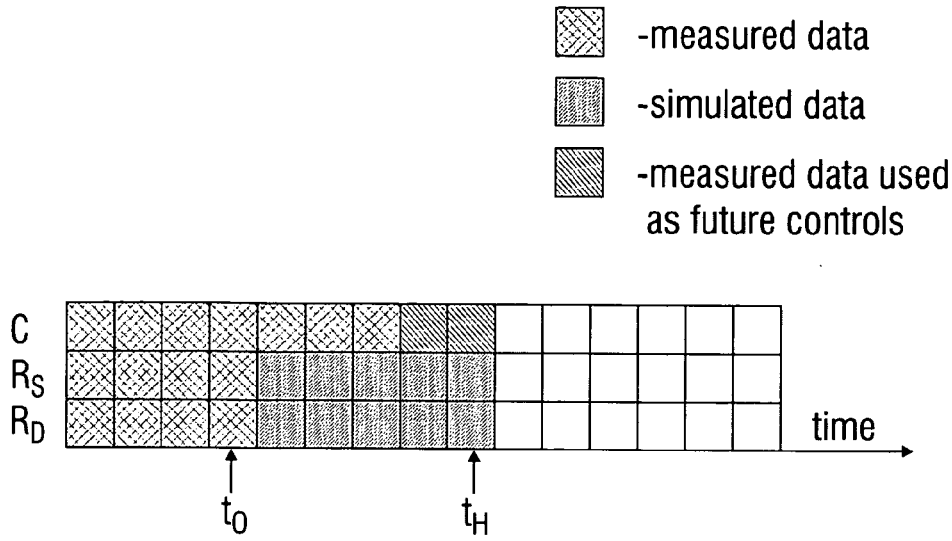
FIG. 8 shows the use of measured, simulated, and measured data used a future controls during modeling.

Estimation of the formation at the bit may be very useful not only for the DCS but for other applications swell. It is feasible to evaluate the properties of the formation at the bit using dynamic data. For this purpose neural networks were created; they used the current values of WOB, RPM, ROP and downhole diagnostics as inputs. FIG. 8 illustrates that such straight forward attempts to estimate formation properties did not yield very good results. A more complex approach will be desirable to design NN predictions for such a purpose.

Testing of dynamic models was performed offline using data collected during the field test. Various parameters that affect the creation of a NN model and influence its performance (i.e., how well it simulates the dynamic system) were evaluated in these tests. The testing included an assessment of the particular inputs used for NN training, the number of neurons utilized in NN, duration of the modeling step, and so on.

Figure 9:
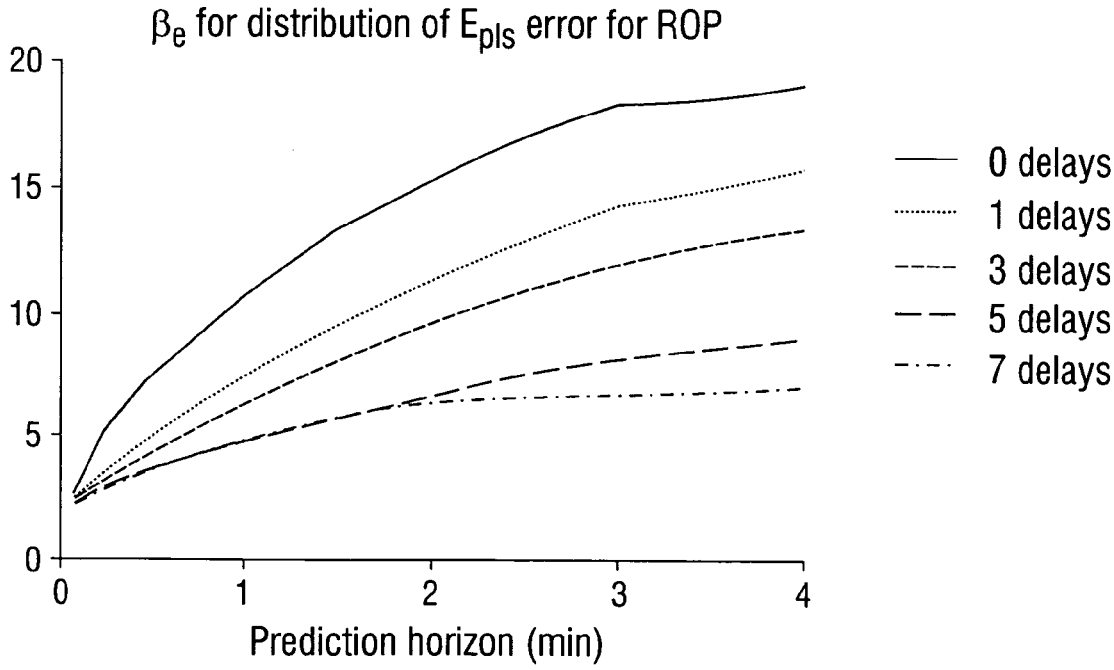
FIG. 9 shows accuracy of prediction for various modeling step sizes.

For each test, 60% of the available data were used for building a model. Each model was trained to predict certain responses one time-step ahead. Trained models were then tested on the remaining 40% of the data. A set of models was used to simulate the future responses several time-steps ahead. Controls that were actually observed during the field test were used as future controls as shown in FIG. 9.

To evaluate the accuracy of such a multi-step prediction, the computed values of the responses were compared to the actual responses measured the same number of steps ahead, and a percentage full scale (% FS) error was computed. It was found that errors computed during each test have a distribution which is approximated by the following function:

$$f_e(x) = \frac{1}{2\beta_e}\exp\left(-\left|\frac{x}{\beta_e}\right|\right)$$

Value of $_e$ was computed in each test to produce the best fit of function (3) to the test error distribution. This "effective" prediction error ($_e$) allowed a consistent comparison of the accuracy of different models investigated in different tests and was used to determine optimal values of parameters that affected the creation of the NN model and influence its performance.

Figure 10:
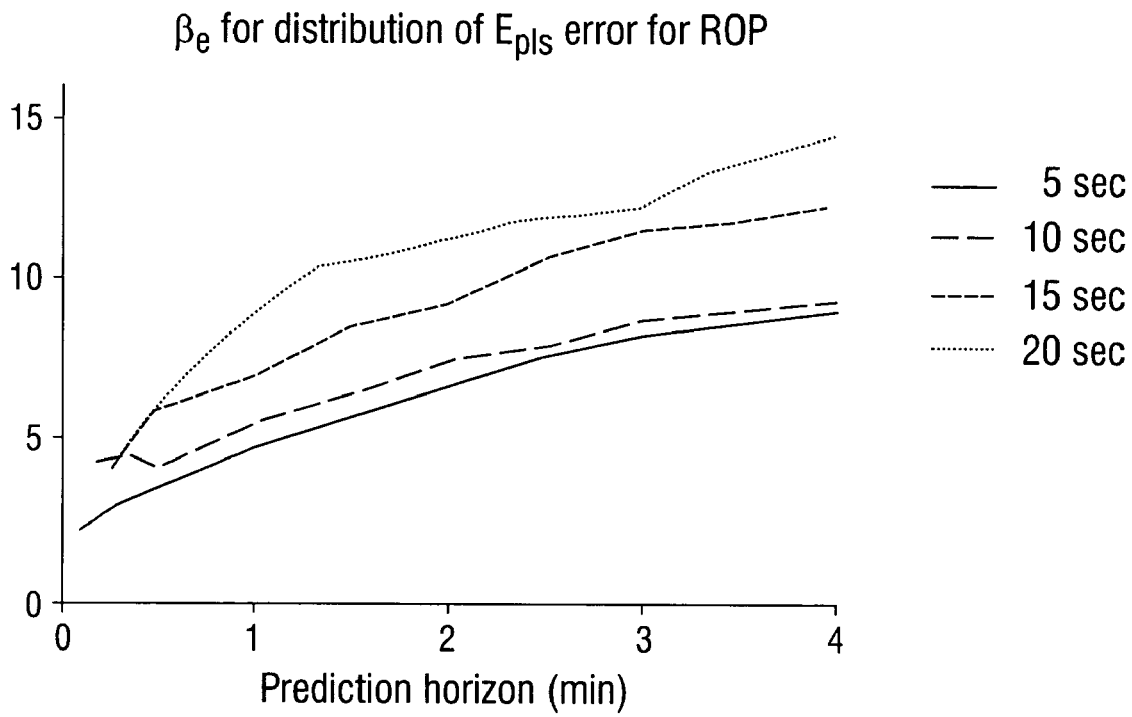
FIG. 10 graphically illustrates accuracy of prediction for modeling steps of different durations.

One parameter that was evaluated is the amount of delays at the neural network input. Although feed forward neural networks are essentially static, their usage may be extended to solve dynamic problems by utilizing delay lines. In other words by using data from a number of previous time steps. FIG. 10 shows how the accuracy of models that use the same inputs depends on the number of delays. Duration of the time step in these tests was five seconds.

Prediction error grows with an increase in the prediction horizon. However, as FIG. 10 illustrates, a larger number of time delays improves accuracy. The same behavior was observed for models that use different sets of inputs and for different durations of the modeling step. More time delays mean more inputs into the NN, resulting in a larger problem to be solved to train the model. This in turn increases time to train the NN model.

Figure 11:
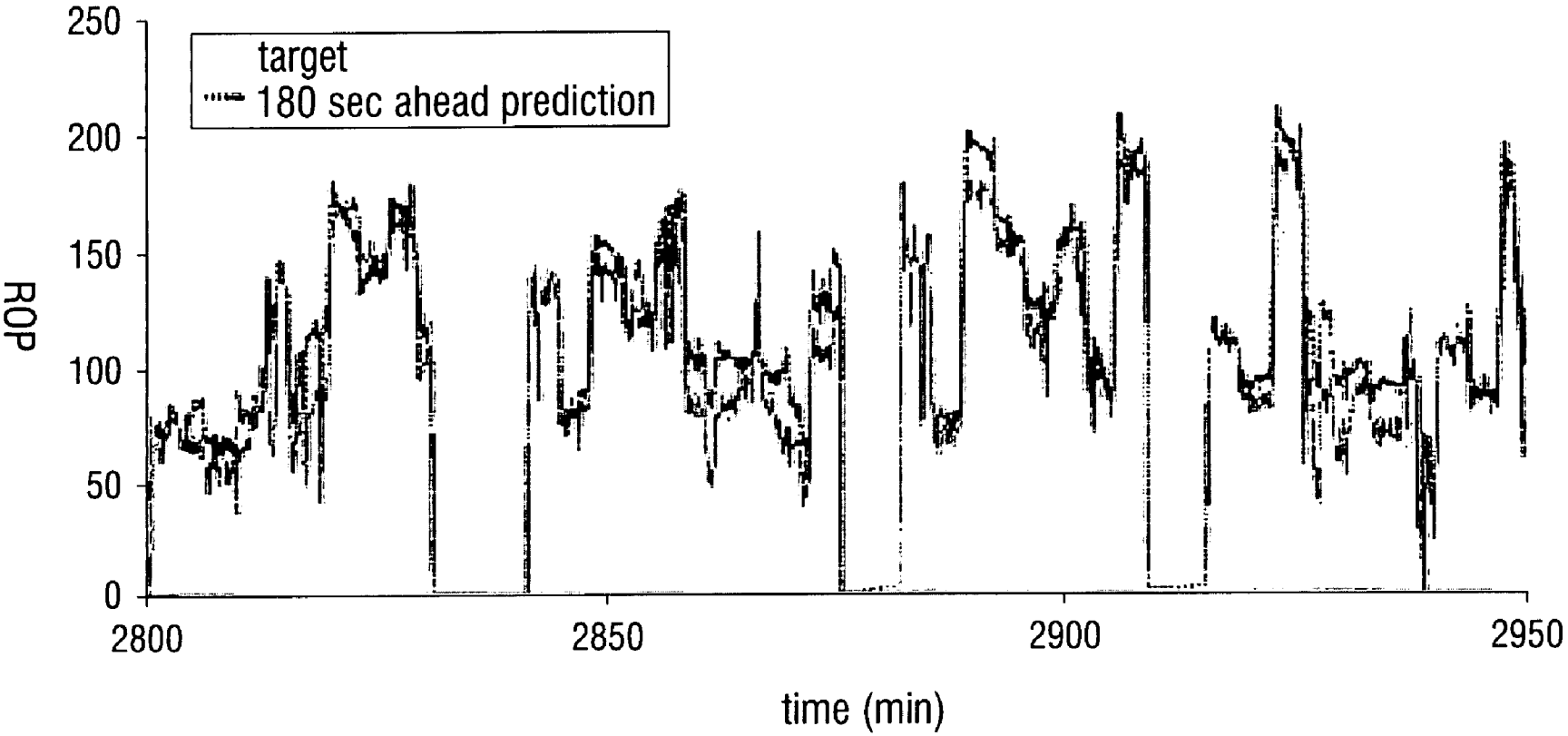
FIG. 11 shows prediction at thirty-six steps ahead of rate of penetration by a model using five (5) second intervals.
Figure 12:
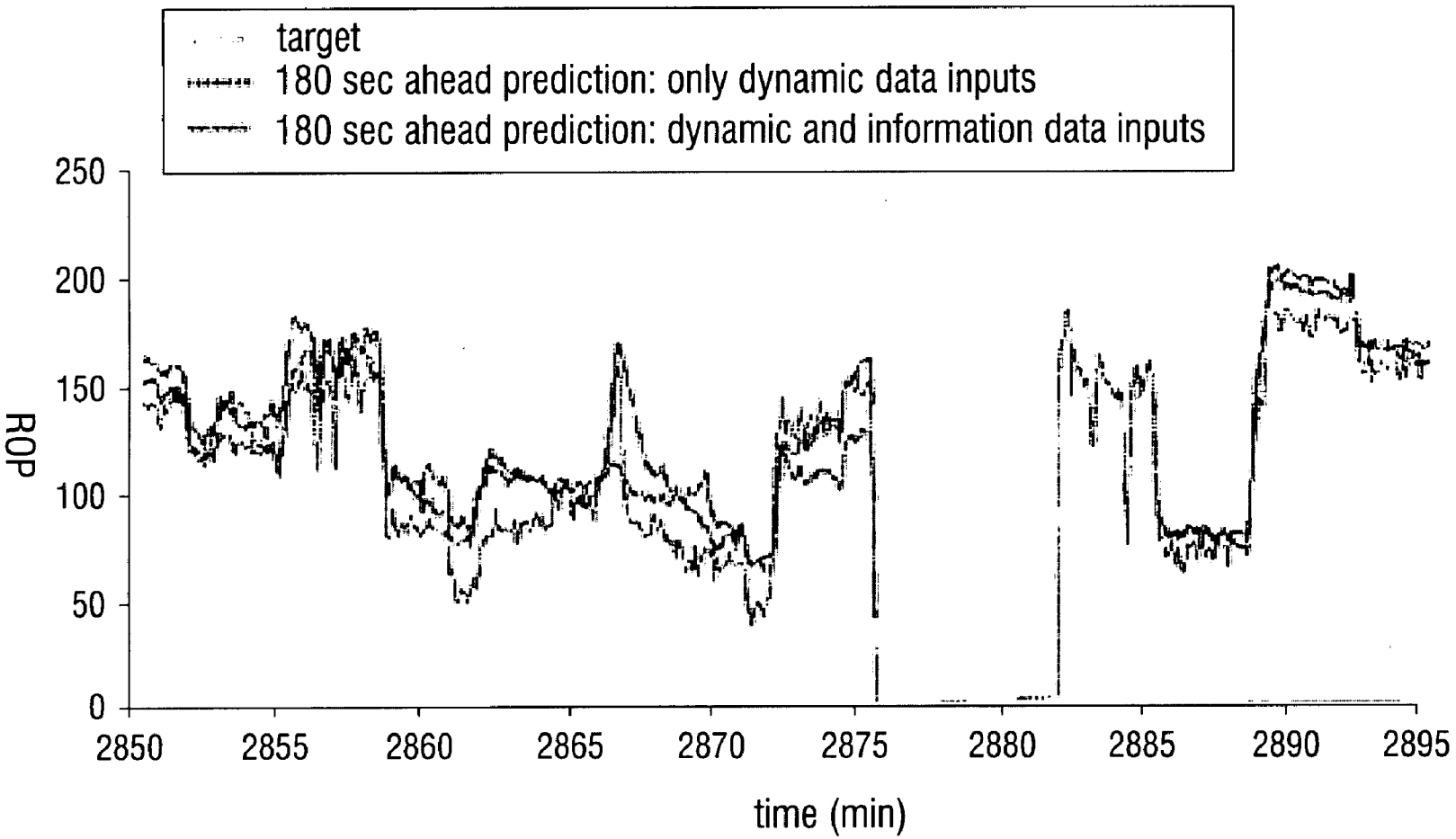
FIG. 12 graphically illustrates the improvement in prediction accuracy when look ahead information is used.

Another example of a parameter that influences the performance of the dynamic neural network models is the duration of the time step. The minimum duration of the time step feasible for the particular data acquired during the field test was five seconds. For longer intervals, the value of each mnemonic was computed by averaging the available data over the time step. FIG. 11 shows accuracy of prediction for modeling steps of different durations. It is observed that although the models operating on shorter time steps would require more steps to estimate value of responses for the same time horizon, they produce better results. Based on optimal values of these and other parameters, NN models simulating the drilling process were created. FIG. 12 shows actual ROP against predicted ROP.

During the simulation (prediction three minutes ahead in this example) actual controls measured during the field test were used as future inputs. Actual responses were used to initialize simulation of drilling dynamics. No actually measured responses were used when simulation had started. The dynamic model, tested in such a way, cannot accommodate for formation changes which happen within three minutes of simulation. Nevertheless, the model showed good results when formation did not change substantially.

If information about the formation to be drilled is available, then it may be used to a great benefit in dynamic models. Another model of the drilling process which utilizes look-ahead formation information to make predictions was created using data from an offset-well. FIG. 13 shows the measured and simulated ROP for the part of the test that drilled through a section with fast formation changes. Clearly, models using formation data as inputs perform better in this complex situation.

In summary, the structure of the drilling process has been studied to create a design of a "Drilling Advisor" that provides recommendations regarding which drilling controls to adjust, and when to adjust such controls. Neural network models, along with an optimization strategy, were designed to fit this concept and implemented and tested.

For the model development a pseudo-statistical approach was employed as an alternative to traditional analytical and numerical approaches. This approach is based on long-term accumulation of practical field knowledge and utilization of this knowledge for overall improvement of the model and implementation of self-learning and self-adjusting capabilities during drilling. Neural network models can predict development of the drilling process accurately enough when used on wells drilled through similar lithology with the same BHA and bit. Better accuracy may be achieved, especially for long term prediction, when information about the formation along the well path is available (for example, from offset wells).

The benefits of a closed loop Drilling Control System are many, and touch several aspects of the drilling and evaluation process. The benefits Relating to Performance Drilling utilizing DCS include Improved ROP, longer bit runs, more sections drilled in a single run, in gauge hole (Less formation drilled), reduced downhole vibration, less wasted energy downhole, less trips due to MWD failure, reduced BHA failure, steady state drilling, consistent start up after connections. The benefits relating to formation evaluation measurements include: improved quality of measurement, in gauge hole, reduced time between drilling and measurement, less vibration effects on measurements, improved MWD data transmission, less noise due to vibration.

The foregoing description is directed to particular embodiments of the present invention for the purpose of illustration and explanation. It will be apparent, however, to one skilled in the art that many modifications and changes to the embodiment set forth above are possible without departing from the scope and the spirit of the invention. It is intended that the following claims be interpreted to embrace all such modifications and changes.

Nomenclature

BHA=bottomhole assembly $C_n$=control parameters at n-th time step

DCS=drilling control system $E_n$=environment properties at n-th time step

MWD=measurement while drilling

NN=neural network
ROP=drilling rate of penetration
RPM=rotations per minute
$R_n$=responses at n-th time step
$R_S$=surface measured responses
$R_D$=downhole measured responses
TVD=true vertical depth
WOB=weight on bit
% FS=percent of full scale error

What is claimed is:

1. A system for forming a wellbore in a subterranean formation, comprising;

(a) a drilling system including a rig positioned at a surface location, a drill string conveyed into the wellbore by the rig, the drill string having a bottomhole assembly (BHA) attached at an end thereof, and a plurality of sensors associated with the drilling system for measuring surface responses and downhole responses of the drilling system during drilling; and (b) a controller operatively coupled to the drilling system and including at least one model for predicting behavior of the drilling system, the controller utilizing the at least one model, the measured surface and downhole responses and at least one selected control parameter to predict behavior of the drilling system and to determine at least one advice parameter that produces at least one selected optimized drilling parameter while satisfying at least one selected constraint.

2. The system according to claim (1) wherein the at least one selected control parameter is one of: (I) weight-on-bit, (ii) RPM of the drill string, (iii) RPM of the drill bit; (iv) hook load, (v) drilling fluid flow rate, and (vi) drilling fluid properties.

3. The system according to claim (1) wherein the surface responses are one of (i) surface torque, (ii) oscillations of hook load, (iii) and rate-of-penetration, and (iv) oscillation of torque.

4. The system according to claim (1) wherein the downhole responses are one of (i) drill string vibration, (ii) BHA vibration, (iii) weight-on-bit, (iv) RPM of the drill bit, (v) drill bit RPM variations, and (vi) torque at the drill bit.

5. The system according to claim (1) wherein the at least one advice parameter is one of (i) drilling fluid flow rate; (ii) drilling fluid density, (iii) weight-on-bit, (iv) drill bit RPM, and (v) bottombole pressure.

6. The system according to claim (1) wherein the at least one selected optimized drilling parameter is one of: (i) rate-of-penetration, (ii) hole cleaning, and (iii) annular pressure.

7. The system according to claim (1) wherein the at least one model utilizes data relating to one of: (i) geometry of the BHA, (ii) mechanical parameters of the BHA, (iii) characteristics of a drill bit carried by the BHA, (iv) characteristics of a drilling motor in the BHA; (v) wellbore geometry, (vi) well profile; (vii) lithology of the subterranean formation being drilled; (viii) mechanical properties of the subterranean formation being drilled; (iv) lithology data obtained of an offset well; and (viii) formation mechanical property data obtained from an offset well.

8. The system according to claim (1) wherein the controller includes a plurality of model modules, each the model module producing a predicted value of a future response and cost associated with the future response, the controller utilizing the plurality of model modules to evaluate drilling efficiency.

9. The system according to claim (1) wherein the controller updates the at least one model in real-time using an error calculation between a measured value for a drilling system response and a predicted value for the drilling system response.

10. The system according to claim (1) wherein the selected drilling response includes a measured downhole response that is preprocessed and decimated by a downhole tool; and further comprising a telemetry system for transmitting the decimated and preprocessed measured downhole response to the controller.

11. The system according to clam (1) wherein the controller utilizes hole cleaning and annular pressure calculations to determine whether an annulus of the wellbore is overloaded with cuttings formed during drilling.

12. The system according to claim (1) wherein the controller provides closed-loop control for the drilling system wherein the determined advice parameter is used to issue appropriate command signals to the drilling system.

13. A system for forming a wellbore in a subterranean formation, comprising:

(a) a drilling system including a rig positioned at a surface location, a drill string conveyed into the wellbore by the rig, the drill string having a bottomhole assembly (BHA) attached at an end thereof, and a plurality of sensors associated with the drilling system for measuring surface responses and downhole responses of the drilling system during drilling; and (b) a controller operatively coupled to the drilling system and including at least one model for predicting behavior of the drilling system, the controller utilizing the at least one model, the measured surface and downhole responses and at least one selected control parameter to predict behavior of the drilling system and to determine at least one advice parameter that produces at least one selected optimized drilling parameter while satisfying at less on selected constraint; wherein the controller includes a neural network.

14. A method for forming a wellbore in a subterranean formation, comprising:

(a) providing a drilling system including a rig positioned at a surface location, a drill string conveyed into the wellbore by the rig, the drill string having a bottomhole assembly (BHA) attached at an end thereof, (b) measuring surface responses and downhole responses of the drilling system during drilling using a plurality of sensors; and (c) determining at least one advice parameter that produces at least one selected optimized drilling parameter while satisfying at least one selected constraint using a controller, the controller making the determination using at least one model for predicting behavior of the drilling system, at least one selected control parameter, and the measured surface and downhole responses.

15. The method according to claim (14) wherein the at least one selected control parameter is one of: (i) weight-on-bit, (ii) RPM of the drill string, (iii) RPM of the drill bit; (iv) hook load, (v) drilling fluid flow rate, and (vi) drilling fluid properties.

16. The method according to claim (14) wherein the surface responses are one of (i) surface torque, (ii) oscillations of hook load, (iii) and rate-of-penetration, and (iv) oscillation of torque.

17. The method according to claim (14) wherein the downhole responses are one of (i) drill string vibration, (ii) BHA vibration, (iii) weight-on-bit, (iv) RPM of the drill bit, (v) drill bit RPM variations, and (vi) torque at the drill bit.

18. The method according to claim (14) wherein the at least one advice parameter is one of (i) drilling fluid flow rate; (ii) drilling fluid density, (iii) weight-on-bit, (iv) drill bit RPM, and (v) bottomhole pressure.

19. The method according to claim (14) wherein the at least one selected optimized drilling parameter is one of: (i) rate-of-penetration, (ii) hole cleaning, and (iii) annular pressure.

20. The method according to claim (14) wherein the controller is provided with at least one model used to determine the advice parameter, the at least one model utilizing data relating to one of: (i) geometry of the BHA, (ii mechanical parameters of trio BHA, (iii) characteristics of a drill bit carried by the BHA, (iv) characteristics of a drilling motor in the BHA; (v) wellbore geometry, (vi) well profile; (vii) lithology of the subterranean formation being drilled; (viii) mechanical properties of the subterranean formation being drilled; (iv) lithology data obtained of an offset well; and (viii) formation mechanical property data obtained from an offset well.

21. The method according to claim (14) wherein the controller includes a plurality of model modules, each model module producing a predicted value of a future response and cost associated with the future response, the controller utilizing the plurality of model modules to evaluate drilling efficiency.

22. The method according to claim (14) wherein the controller updates the at least one model in real-time using an error calculation between a measured value for a drilling system response and a predicted value for the drilling system response.

23. The method according to claim (14) wherein the selected drilling response includes a measured downhole response that is preprocessed and decimated by a downhole tool; and further transmitting the decimated and preprocessed measured downhole response to the controller with a telemetry system.

24. The method according to claim (14) wherein the controller utilizes hole cleaning and annular pressure calculations to determine whether an annulus of the wellbore is overloaded with cuttings formed during drilling.

25. The method according to claim (14) wherein the controller provides closed-loop control for the drilling system, wherein the determined advice parameter is used to issue appropriate command signals to the drilling system.

26. A method for forming a wellbore in a subterranean formation, comprising:

(a) providing a drilling system including a rig positioned at a surface location, a drill string conveyed into the wellbore by the rig, the drill string having a bottomhole assembly (BHA) attached at an end thereof, (b) measuring surface responses and downhole responses of the drilling system during drilling using a plurality of sensors; and (c) determining at least one advice parameter that produces at least one selected optimized drilling parameter while satisfying at least one selected constraint using a controller, the controller making the determination using at least one model for predicting behavior of the drilling system, at least one selected control parameter, and the measured surface and downhole responses, wherein the controller includes a neural network.

* * * * *